United States Patent [19]

Fujii et al.

[11] 4,024,844

[45] May 24, 1977

[54] IGNITION DEVICE FOR AN INTERNAL COMBUSTION ENGINE WITH CAM DESIGN FOR PREVENTING UNDESIRED FIRINGS

[75] Inventors: Hideo Fujii; Minoru Kato, both of Kariya, Japan

[73] Assignee: Nippondenso Co., Ltd., Kariya, Japan

[22] Filed: Apr. 23, 1974

[21] Appl. No.: 463,429

[30] Foreign Application Priority Data

Apr. 28, 1973 Japan ..... 48-51468[U]

[52] U.S. Cl. ..... 123/41 R; 123/148 AC

[51] Int. Cl.² ..... F01L 13/02

[58] Field of Search ..... 123/41, 148 CC, 148 E, 123/148 AC, 149 A, 149 D, 148 S; 201/19 A, 30 A

[56] References Cited

UNITED STATES PATENTS

| | | | |
|---|---|---|---|
| 3,362,389 | 1/1968 | Johnson | 123/41 |
| 3,435,264 | 3/1969 | Brand et al. | 123/148 AC |
| 3,518,978 | 7/1970 | Schmiedel | 123/41 |
| 3,554,179 | 1/1971 | Burson | 123/148 CC |
| 3,648,675 | 3/1972 | Gemander | 123/41 R |
| 3,795,235 | 3/1974 | Donohue et al. | 123/148 CC |
| 3,826,236 | 7/1974 | Carlsson | 123/148 E |

OTHER PUBLICATIONS

Cams – Design, Dynamics, and Accuracy, H. A. Rothbart, Copyright 1956, pp. 30–58, 94–96.

*Primary Examiner*—C. J. Husar
*Assistant Examiner*—Paul Devinsky
*Attorney, Agent, or Firm*—Cushman, Darby & Cushman

[57] ABSTRACT

This invention relates to an ignition device for an internal combustion engine, in which a primary winding of an ignition coil and a breaker contact are connected in series and the breaker contact is so designed that wanted high voltages are produced only when the breaker contact is opened, whereby the engine is prevented from rotating in a reverse direction.

6 Claims, 6 Drawing Figures

IGNITION DEVICE FOR AN INTERNAL COMBUSTION ENGINE WITH CAM DESIGN FOR PREVENTING UNDESIRED FIRINGS

BACKGROUND OF THE INVENTION

1. Field of the Invention

The present invention relates to an ignition device which may be employed in 2-cycle engines for motorcycles or snowmobiles, especially to an ignition device having a contact point in which a magneto generator is used as an electric power source.

2. Description of Prior Art

In a conventional ignition device especially employed in a 2-cycle engine, a magneto generator is used as an electric power source, and a breaker contact and a primary winding of an ignition coil are connected in parallel to a generating coil of the magneto generator. In the ignition device of this kind, several high voltages other than that of a normal ignition timing are induced at a spark plug while the breaker contact opens. It comes from the fact that when the magnetic flux flowing through the generating coil changes from one direction to the other at a specific point, which is hereinafter referred to as a magnetically neutral point, change of the magnetic flux induces a sufficient high voltage to produce an ignition spark. These induced high voltages at the magnetically neutral points do not influence the engine operation during the normal running of the engine, since the high voltages are produced after the ignition spark at the normal ignition timing produced when the breaker contact opens, and further they are after a top deadcenter. However, when the engine rotates in the reverse direction by accident, the induced high voltages may be produced before and near the top deadcenter so that sufficient combustion energy is obtained to continue the reverse rotation of the engine.

SUMMARY OF THE INVENTION

It is therefore a primary object of the present invention to provide an ignition device which prevents a reversely rotated engine from producing such combustion as to cause continued rotation in the reverse direction by such induced voltages.

It is another object of the present invention to provide an ignition device in which a generating coil of a magneto generator, a primary winding of an ignition coil and a breaker contact are connected in series and a timing of opening the breaker contact and an induced voltage are selected after the top deadcenter, during the reverse rotation of the engine.

It is a further object of the present invention to provide an ignition device which is free from abnormal firing during the normal rotation of the engine.

It is a furthermore object of the present invention to provide an ignition device in which there is provided means for invalidating induced voltage produced by change of magnetic flux flowing through the generating coil.

DESCRIPTION OF THE PREFERRED EMBODIMENT

Figure 1:
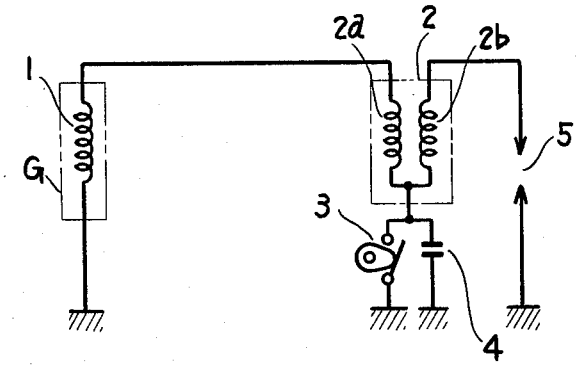
FIG. 1 is an electric wiring diagram showing the first embodiment of the present invention.

Now referring to FIG. 1 showing the first embodiment of the present invention, a letter G designates a well-known magneto generator which comprises a rotor and a stator mounting a generating coil 1 energized by said rotor. A numeral 2 designates an ignition coil having a primary winding 2*a* and a secondary winding 2*b*. Each one end thereof is connected together and is grounded to the earth through a parallel circuit of a breaker contact 3 and an arc-suppressing capacitor 4. The other end of said primary winding 2*a* is connected to a non-grounded end point of said generating coil 1 while the other end of said secondary winding 2*b* is grounded through a spark plug 5.

In this embodiment, the cam-open-angle is selected to be such a value as to prevent the induced voltage which is not necessary for the ignition spark from being produced at the ignition coil 1.

Figure 2:
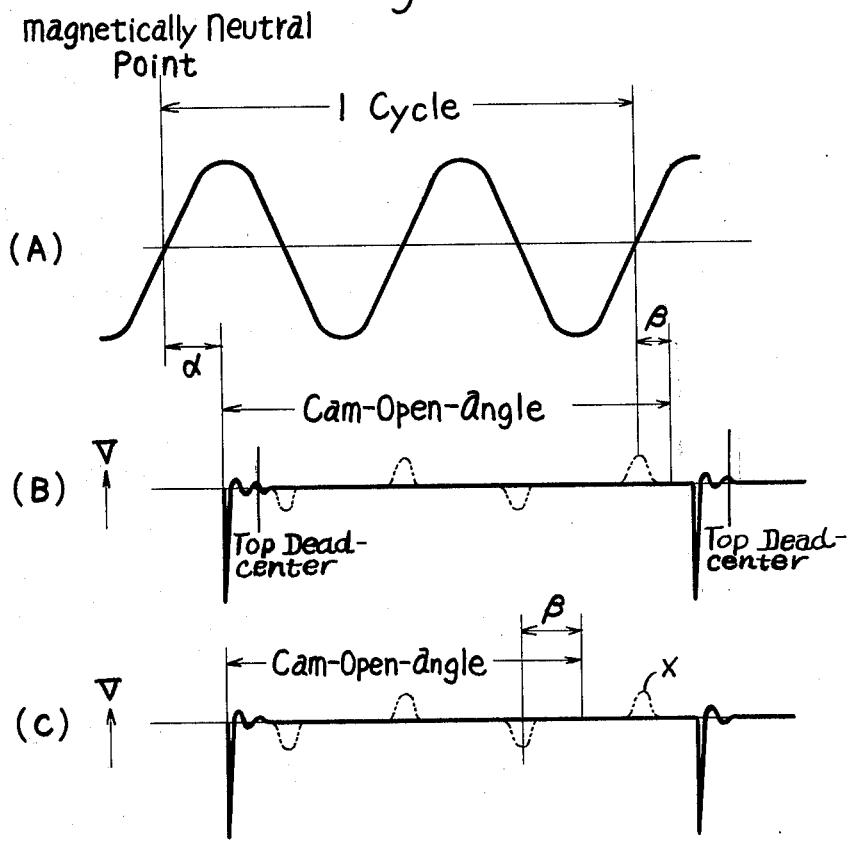
FIGS. 2 and 3 are waveform diagrams for explaining the operation of the present invention.

The value of the cam-open-angle Z is determined by the following equation (A);

$$Z = \left(\frac{360°}{P} - \alpha\right) + \frac{360°}{P} \times (P - 1) + \beta \qquad \text{(A)}$$

wherein,

P; number of magnetic poles of the magneto generator, $\alpha$; value, of an angle from the magnetically neutral point shown in FIG. 2 (A) to the opening point of the breaker contact 3, and $\beta$; value of an angle from the magnetically neutral point to the closing point of the breaker contact 3.

Here, examples of a four-pole and a six-pole magneto generators will be explained, whose waveforms are respectively shown in FIGS. 2 and 3, in which "1 cycle" indicates a period during which the engine rotates one time.

When each value of $\alpha$ and $\beta$ is respectively selected to be 20° and 10° for both a four-pole magnetic magneto generator and a six-pole magneto generator, the value of the cam-open-angle for both generators is determined at 350°.

Figure 3:
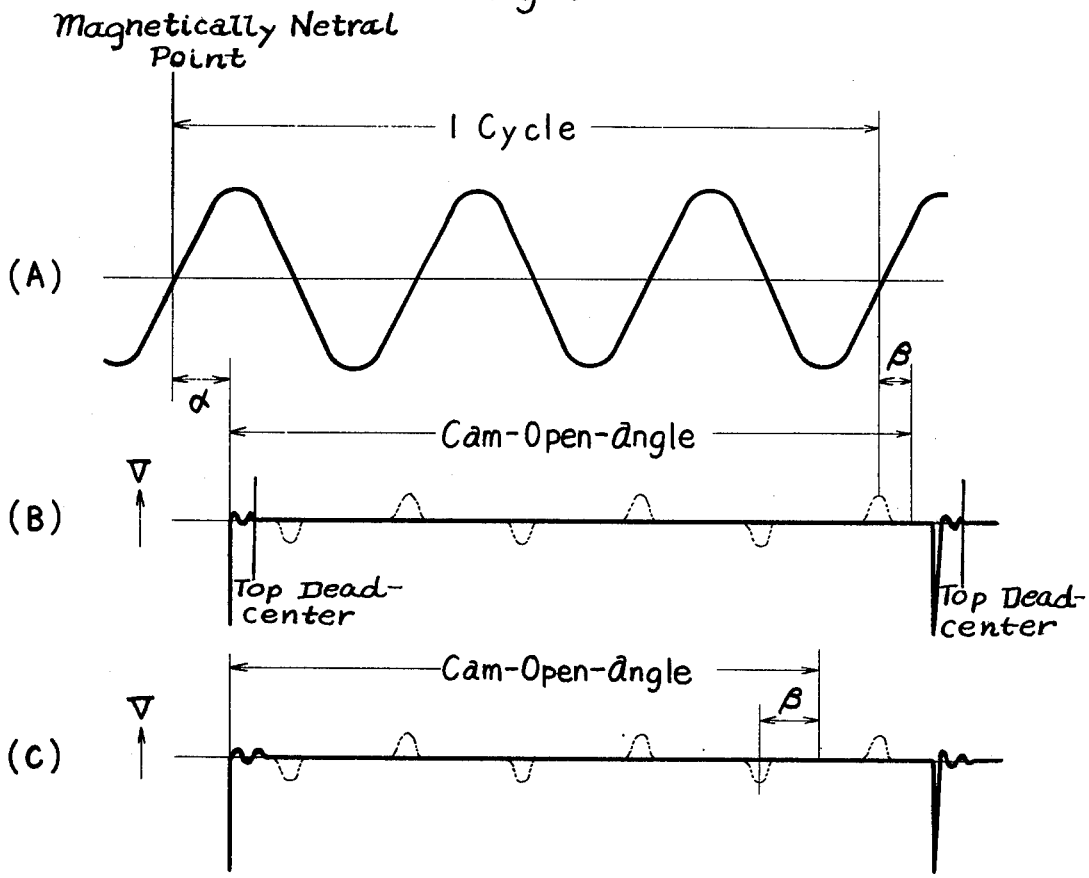

With either one of above mentioned generators, when it is rotated in the normal direction, the ignition voltage is generated when the breaker contact 3 is opened as shown in FIG. 2 (B) or FIG. 3 (B). Needless to say, the breaker contact 3 opens before a top deadcenter of the engine as shown in FIGS. 2 and 3.

It is noted that the high voltage to be otherwise induced at the magnetically neutral points as shown by dotted lines in FIGS. 2 (B) and 3 (B) are not produced, since the neutral points are embraced by the cam-open-angle, thereby preventing the abnormal firing.

When the engine rotates in the reverse direction by accident, for example, when a motorcycle moves backward on a sloping road, an ignition spark is produced just at a point where the breaker contact 3 opens, in other words, at the point where the breaker contact 3 closes during the normal running of the engine. As clearly noted from FIGS. 2 and 3, the point is located behind the top deadcenter where the engine can not obtain sufficient energy to continue the reverse rotation even through the ignition spark is produced, so that continuous reverse rotation of the engine is prevented.

It is further noted that especially in a four-pole or six-pole magneto generator, abnormal firing may be caused by the induced voltage which is produced at the neutral point just before the normal ignition timing, that the phase or the polarity of this induced voltage is different from that of the high voltage at the normal ignition timing, and therefore that the abnormal firing can be prevented by selecting the value of the cam-open-angle which is subtracted by a angle of (360°/ the number of magnetic poles) from the value of the cam-open-angle determined by said equation (A), and providing invalidating means comprising a polarity discriminating element such as a diode.

Accordingly the value of the cam-open-angle Z is determined by the following equation (B);

$$Z = \left(\frac{360°}{P} - \alpha\right) + \frac{360°}{P} \times (P - 2) + \beta \qquad \text{(B)}$$

wherein,

P; number of magnetic poles of the magneto generator, $\alpha$; value of an angle from the magnetically neutral point to the opening point of the breaker contact, and $\beta$; value of an angle from the magnetically neutral point to the closing point of the breaker contact.

Figure 4:
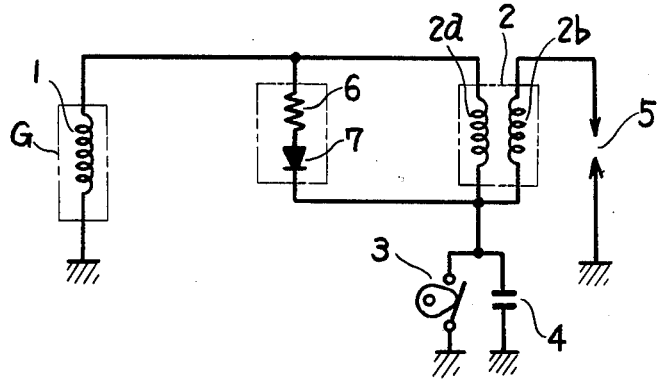
FIGS. 4, 5 and 6 are electric wiring diagrams showing the second, third and fourth embodiments of the present invention.

FIG. 4 shows the second embodiment of the present invention, in which said invalidating means which is a series circuit of a resistor 6 and a diode 7 is connected in parallel with the primary winding 2*a* of the ignition coil 2. When the induced voltage is generated at the generating coil just before the normal ignition timing, the induced voltage is bypassed through the series circuit of the resistor 6 and the diode 7, whereby the high voltage at the ignition coil is substantially invalidated.

An operation of the second embodiment will be explained with reference to FIG. 2 showing the waveforms for a four-pole magneto generator. As the cam-open-angle is determined by said equation (B), three of the high voltages induced at the magnetically neutral points are embraced by the cam-open-angle as shown in FIG. 2 (C) thereby preventing them from being produced. And the last high voltage, which is indicatad by a letter X in FIG. 2 (C), induced at the magnetically neutral point just before the normal ignition timing is broken down by said series circuit of the resistor 6 and the diode 7. Therefore the abnormal firing of the engine due to the induced high voltages at the magnetically neutral points is prevented during the normal running of the engine. And further the reverse rotation of the engine by accident is also prevented form continuing in like manner as described as for the first embodiment, in which the ignition spark is caused behind the top deadcenter during the reverse rotation of the engine.

An operation of the six-pole magneto generator is almost same as that of four-pole magneto generator and therefore it is omitted.

Now when each value of $\alpha$ and $\beta$ is selected for instance to be 20° and 25° for the four-pole magneto generator and 20° and 15° for the six-pole magneto generator, in accordance with equation (B) the values of the cam-open-angle shown in FIGS. 2 (C) and 3 (C) are respectively determined at 275°and 295°.

In the FIG. 4 embodiment, the value of the resistor is so selected, as a value of 1.5 Ω, that this invalidating operation is performed without any influence on the high voltage at the normal ignition timing.

Figure 5:
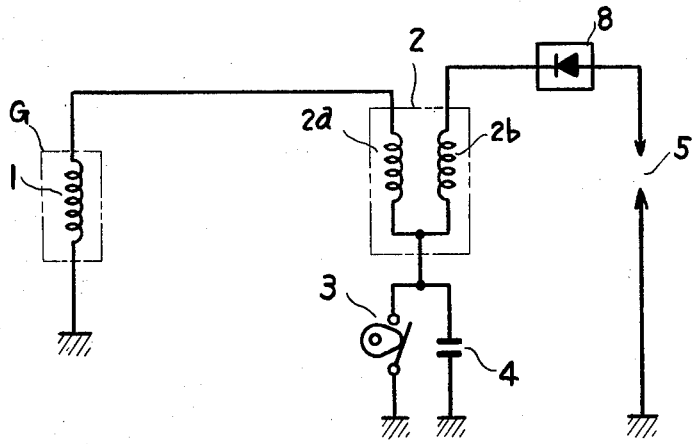

FIG. 5 shows the third embodiment of the present invention, in which a high-voltage-resisting diode 8 is connected between the secondary winding 2*b* of the ignition coil 2 and the spark plug 5, whereby the undesirable induced voltage is eliminated by the diode 8 in the like manner described above.

Figure 6:
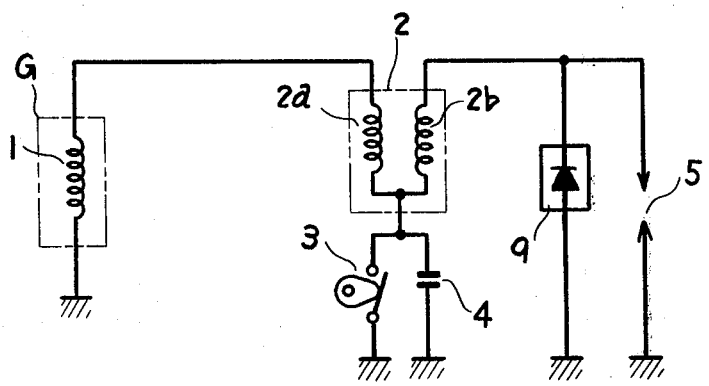

FIG. 6 shows the fourth embodiment of the present invention, in which the high-voltage-resisting diode 9 is connected in parallel with the spark plug 5.

An operation of the fourth embodiment is almost same as the second and third embodiments.

What we claim is:

1. An ignition device for an internal combustion engine comprising:

spark plug;

a magneto generator having a generating coil and being rotated in synchronism with the engine;

an ignition coil having a primary winding connected in series with said generating coil and a secondary winding connected to said spark plug;

a breaker contact connected in series with said primary winding, and cam means synchronized with said engine for opening and closing said contact to prevent undesired firing of said spark plug during forward or reverse engine rotation by being so constructed in profile that the duration Z in which said breaker contact is open is only between 270° and 360° as determined by the following equation:

$$Z = \left(\frac{360°}{P} - \alpha\right) + \frac{360°}{P} \times (P - 1) + \beta$$

wherein,

P is the number of magnetic poles of the magneto generator, $\alpha$ is an angle greater than 0° but less than 360°P measured in a forward direction relative to said forward engine rotation from the first magnetically neutral point in a cycle of said generator to an opening point of said breaker contact, $\beta$ is an angle greater than 0° but less than $\alpha$ measured in said forward direction from the last magnetically neutral point in said cycle to a closing point of said breaker contact.

2. An ignition device as in claim 2 wherein said cam means is the sole means for preventing all undesired firings of said spark plug during both forward reverse rotation of said engine.

3. In an ignition device for an internal combustion engine having at least one spark plug, the improvement comprising:

a magneto generator having a generating coil and P poles and a rotor for rotation in synchronism with said engine to develop P magnetically neutral points during each rotor cycle, an ignition coil having primary winding connected in series with said generating coil and a secondary winding constructed for connection to said spark plug, a breaker contact connected in series with said primary winding, and cam means for opening and closing said contact in synchronism with said engine, said cam means being so oriented and constructed in profile as to close said contact during each said rotor cycle for only a duration which is less than 360°/P and which is located in each rotor cycle so that the contact open period during the remainder of each rotor cycle encompasses all of the said P magnetically neutral points during each such cycle for preventing magneto generator voltages generated at said neutral points from energizing said primary winding regardless of the direction of rotor rotation and so that when said contact is opened by said cam means during any cycle of rotation either forwardly or backwardly by respective forward or reverse rotation of said engine the timing of the resultant ignition coil voltage during undesired reverse engine rotation is predetermined to prevent maintenance of such reverse rotation but during said forward engine rotation is predetermined to fire said spark plug at a desired time to maintain such forward engine rotation.

4. In an ignition device for an internal combustion engine having at least one spark plug, the improvement comprising:

a magneto generator having a generating coil and a rotor for rotation in synchronism with said engine;

an ignition coil having a primary winding connected in series with said generating coil and a secondary winding constructed for connection to said spark plug;

a breaker contact connected in series with said primary winding; and cam means for opening and closing said contact in synchronism with said engine;

said cam means being the sole means for preventing all undesired firings of said spark plug during both forward and reverse rotation of said engine and being so constructed in profile as to maintain said contact open during each cycle of said rotor for a duration which is more than 360°/P (P-1) and less than 360°, wherein P is the number of magneto generator poles.

5. In an ignition device for an internal combustion engine having at least one spark plug, the improvement comprising:

a magneto generator having a generating coil and rotor for rotation in synchronism with said engine;

an ignition coil having a primary winding connected in series with said generating coil and a secondary winding constructed for connection to said spark plug;

a breaker contact connected in series with said primary winding; and cam means for opening and closing said contact in synchronism with said engine;

said cam means for preventing undesired firings of said spark plug and being constructed in profile as to maintain said contact open during each cycle of said rotor for a duration which is only between 360°/P (P-1) and 360° as determined by the following equation:

$$Z = \left(\frac{360°}{P} - \alpha\right) + \frac{360°}{P} \times (P - 1) + \beta$$

wherein

P is the number of magnetic poles of the magneto generator;

$\alpha$ is an angle greater than 0° but less than 360°/P measured in a forward direction relative to said forward engine rotation from the first magnetically neutral point in a cycle of said generator to an opening point of said breaker contact;

$\beta$ is an angle greater than 0° but less than $\alpha$ measured in said forward direction from the last magnetically neutral point in said cycle to a closing point of said breaker contact.

6. An ignition device as in claim 5 wherein said cam means is the sole means for preventing all undesired firings of said spark plug during both forward and reverse rotation of said engine.

* * * * *